US005868587A

United States Patent [19]

Westlund

[11] Patent Number: 5,868,587

[45] Date of Patent: Feb. 9, 1999

[54] COMPONENT MOUNTING DEVICE

[75] Inventor: Kent Alan Westlund, Markham, Canada

[73] Assignee: The Whitaker Corporation, Wilmington, Del.

[21] Appl. No.: 803,294

[22] Filed: Feb. 20, 1997

[51] Int. Cl.[6] ..... H01R 13/66

[52] U.S. Cl. ..... 439/567

[58] Field of Search ..... 439/567, 571, 439/554, 557, 82, 751

[56] References Cited

U.S. PATENT DOCUMENTS

| | | | |
|---|---|---|---|
| 4,681,389 | 7/1987 | Nakazawa et al. | 439/567 |
| 4,924,561 | 5/1990 | Yoneyama | 24/453 |
| 5,135,412 | 8/1992 | Sitzler | 439/571 |
| 5,145,407 | 9/1992 | Obata et al. | 439/567 |
| 5,171,165 | 12/1992 | Hwang | 439/567 |
| 5,228,870 | 7/1993 | Gorenc et al. | 439/567 |
| 5,393,247 | 2/1995 | DiOrazio et al. | 439/567 |
| 5,478,257 | 12/1995 | Cachina et al. | 439/567 |
| 5,514,000 | 5/1996 | Krause et al. | 439/248 |
| 5,575,673 | 11/1996 | Dahlem et al. | 439/248 |

*Primary Examiner*—Khiem Nguyen
*Assistant Examiner*—Eugene G. Byrd
*Attorney, Agent, or Firm*—Mary K. VanAtten

[57] ABSTRACT

The invention comprises a holding device having a body member with a central portion and two resilient legs extending therefrom in a first direction. The legs have engagement members for engaging a circuit board. The body member has a hook arm extending in a second direction from the central portion for engagemtne with a component. The hook arm has a first portion extending in the second direction and a resiliently deflectable portion extending towards the central portion. The resiliently deflectable portion being deflectable towards the first portion to allow passage through a mounting hole and has an end for engaging the component to secure the body member thereto. The body member secures the component to the circuit board.

15 Claims, 2 Drawing Sheets

20
28
26
24
30
32
22
42
42
40
40
44
44
46
46
47
47
48
48
49
49

COMPONENT MOUNTING DEVICE

FIELD OF THE INVENTION

This invention is related to a mounting device for locking or securing a component such as an electrical connector to a circuit board.

BACKGROUND OF THE INVENTION

There are numerous ways of securing an electrical connector to a circuit board. For example, the connector may be provided with mounting flanges having bores that align with corresponding apertures on the circuit board. Threaded fasteners can be extended through the bore and the board aperture.

In other arrangements, such as disclosed in U.S. Pat. No. 5,145,407, a holding device is inserted through an opening in a component and has resilient legs for engaging the circuit and securing the circuit board to the component. The mounting device includes one portion having a latch extending angularly from the plane of the mounting device. Further, the mounting device has barbs for securing the mounting device to the component. The mounting device also has legs with a first portion which are tapered outwardly and a second portion which is tapered inwardly to provide spring action transverse to the plane of the mounting device and to engage a hole in the circuit board.

In mounting components to boards, it would be desirable to provide a simple snap in board which can be easily made. It is also desirable to provide a secure connection between the component and the board.

SUMMARY OF THE INVENTION

The invention comprises a holding device having a body member with a central portion and two resilient legs extending therefrom in a first direction. The legs have engagement members for engaging a circuit board. The body member has a hook arm extending in a second direction from the central portion for engagement with a component. The hook arm has a first portion extending in the second direction and a resiliently deflectable portion extending towards the central portion. The resiliently deflectable portion being deflectable towards the first portion to allow passage through a mounting hole and has an end for engaging the component to secure the body member thereto. The body member secures the component to the circuit board.

The invention further comprises a boardlock device having a substantially planar member with a central portion. Two resilient legs extend from the central portion in a first direction. A hook arm extends from the central portion in a second direction. The hook arm has a first section extending from the central portion in a second direction. The hook arm has a resilient arm extending from the first section towards the central portion. The resilient arm provides a snap action to secure the boardlock device into a mounting hole on a component to be mounted to a board. The boardlock device secures the component a circuit board.

The invention further comprises a holding device for securing two components together. The first component has a first mounting hole and the second component having a second mounting hole. The holding device has a central portion with two resiliently deflectable legs extending therefrom. The legs have securing members for engaging and securing the second mounting hole of the second component. A hook arm extends from the central portion for engaging the first mounting hole on the first component. The hook arm has a first portion extending away from the central portion and a second portion extending towards the central portion. The second portion is a resiliently deflectable arm which is deflectable towards the first portion. The holding device secures the first and the second components together.

BRIEF DESCRIPTION OF THE DRAWINGS

An embodiment of the present will now be described with reference to the accompanying drawings, in which.

DETAILED DESCRIPTION OF THE INVENTION

Figures 1, 2, 3, 4, 5, 6:
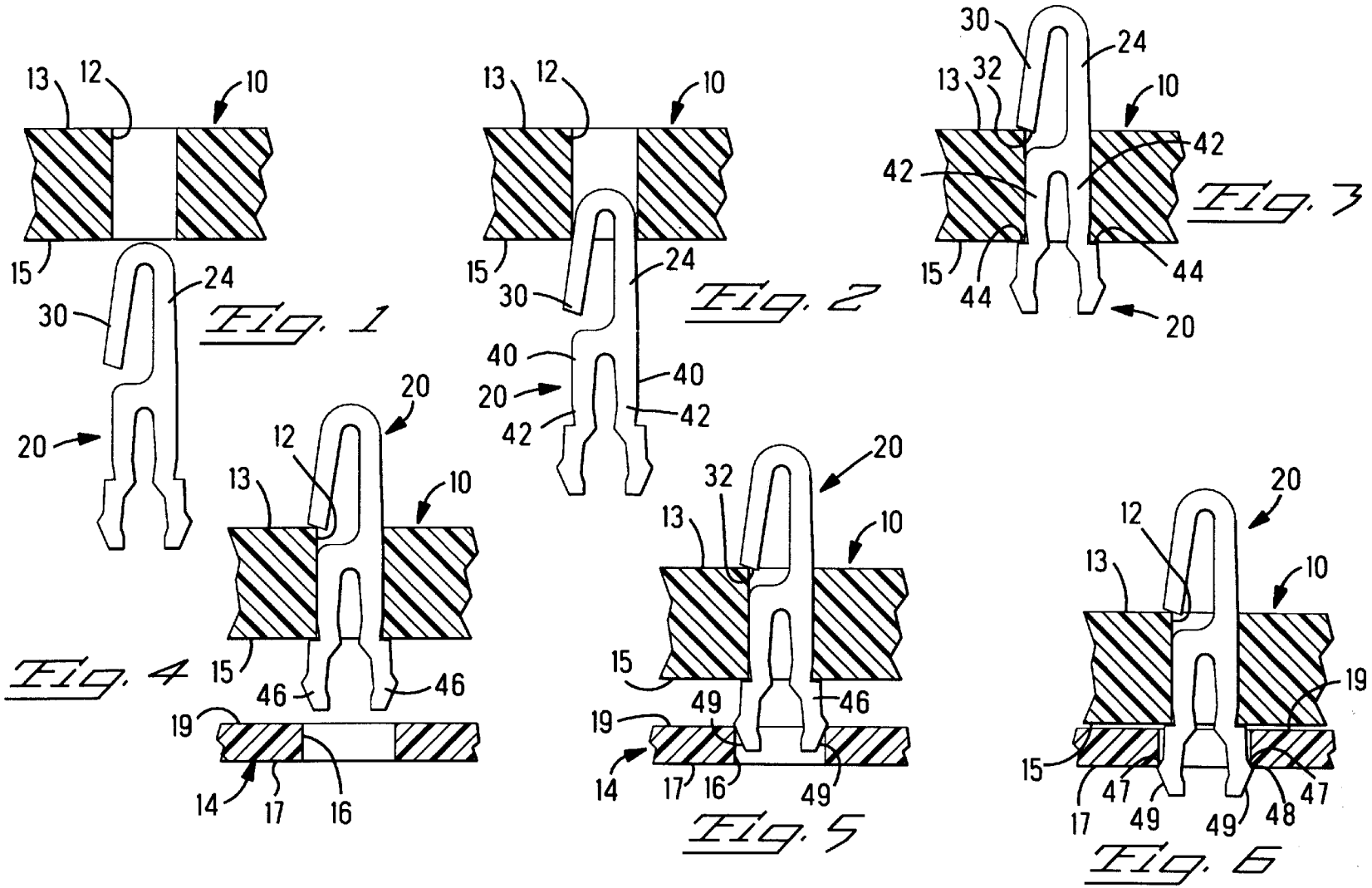
FIG. 1 is a cross sectional view of a component and the holding device of the present invention.
FIG. 2 is a view similar to FIG. 1 showing the insertion of the holding device into the component.
FIG. 3 is a view similar to FIG. 2 showing the holding device secured within the component.
FIG. 4 is a cross sectional view of the component and the board with the holding device of the present invention.
FIG. 5 is a view similar to FIG. 4 showing the engagement of the holding device with the board.
FIG. 6 is a view similar to FIG. 5 showing the housing device secured to the board.

The present invention is directed to a hold down device for securing two components together. The hold down device can be a boardlock, for example, or it can be used to secure varying components together. The component 10 can be, for example, an electrical connector. Furthermore, the other component could be a circuit board 14 or some type of device to which the component 10 is to be secured.

The component 10 has an opening 12 into which the boardlock 20 is received. Furthermore, the printed circuit board 14 has an opening 16 also in which the boardlock will be secured. The component 10 has a top surface 13 and a bottom mating surface 15. The circuit board 14 has a top surface 19 onto which the component 10 will be received and it has a bottom surface 17.

Figure 7:
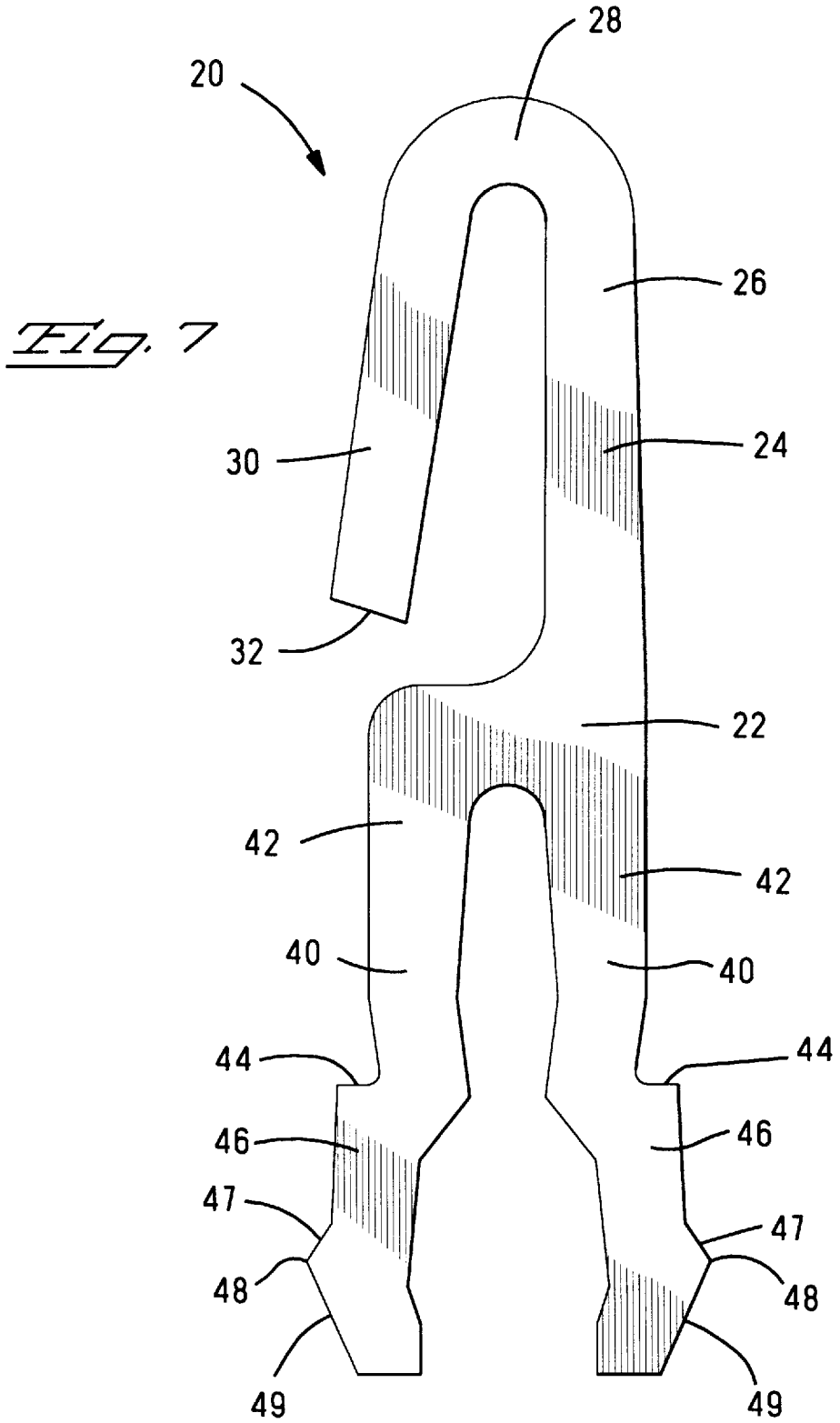
FIG. 7 is a side plane view of the holding device of the present invention.

Boardlock 20 is an essentially planar device which is stamped and formed from sheet metal. The boardlock 20 has a central portion 22. The central portion runs essentially parallel to the top surface 19 of the circuit board 14 and the mating face 15 of the component 10. Extending upwardly from the central portion 22, as shown in FIG. 7, is a hook arm 24. The hook arm 24 includes a first portion 26 which extends essentially straight up and down from the central portion 22. The hook arm 24 then has a bent portion 28 or a rounded over portion and finally a resiliently deflectable portion 30 which is extending back toward the central portion 22. The hook arm 24 forms a cantilevered arm wherein the resiliently deflectable portion 30 can be pushed inwardly towards the first portion 26 but in its normal state extends slightly outwardly from the first portion 26 and the central portion 22. The resiliently deflectable portion 30 has an end surface 32.

The boardlock 20 also has two downwardly extending legs 40, as shown in FIG. 1. The legs 40 are spaced apart from each other and are resiliently deflectable towards each other. Each of the downwardly extending legs 40 has a straight portion 42. At the end of the straight portion 42, in the mid portion of each of the legs 40, is stop member 44. Extending beyond the stop member are boardlock portions 46. Each of the boardlock portions 46 have angled surfaces 47, 49 which converge toward point 48.

In operation, the upper portion of the boardlock 20, as shown in FIG. 1, is first inserted into the mounting hole 12 on the component 10 and secured therein. The width of the hook arm 24 is slightly larger than that of the mounting hole 12, therefore when the boardlock is inserted, the second portion 30 of the hook arm will be resiliently deflected to pass therethrough. The straight portions 42 of legs 40 are dimensioned to be received within the mounting hole 12 without deflection. Upon complete insertion of the boardlock 20, as seen in FIG. 3, the resiliently deflectable portion 30 of the hook arm 24 will snap or resile outwardly thereby having the end 32 of the hook arm engage a top surface 13 of the component. Furthermore, stop members 44 will engage the bottom surface 15 thereby preventing the boardlock from moving further through the mounting hole 12. The engagement of the hook arm 24 with the top surface 13 and the stop members 44 with the bottom surface 15 serve to keep the boardlock captivated within the mounting hole 12.

An alternative arrangement has the width of the straight portions 42 of legs 40 slightly wider than the width of the mounting hole 12. As the boardlock 20 is inserted into the mounting hole 12, the straight portions 42 of the legs 40 will skive the sides of the mounting hole 12 forming a groove, not shown, into which the boardlock will be received. The groove will keep the boardlock from rotating within the mounting hole 12. The stop members 44 will engage the bottom surface 15 to keep the boardlock 20 captivated within the mounting hole 12.

The boardlock 20 is secured to the component 10 so that is ready to be mounted and secured to the board 14. When the component is mounted, the boardlock portion 46 of the legs 40 first engage the mounting hole 16. The boardlock portion of the boardlock is wider than the mounting hole 16. When the angled surfaces 49 engage the mounting hole 16, the legs 40 are deflected inwardly towards each other. When the point 48 is received beyond the mounting hole 16, the legs 40 will resile back towards their initial position and the angled surfaces 47 will engage the bottom surface 17 of the circuit board 14 and secure the component 10 to the circuit board 14 with the mating face 15 of the component 10 against the top surface 19 of the circuit board 14.

The engagement of the angled surfaces 47 and the points 48 on the bottom surface of the printed circuit board will secure the connector for the component to the printed circuit board. The use of angled surfaces 47 allow for differences in the width of the board 14 because the board 14 can be engaged at any position along the angled surfaces 47.

In the preferred embodiment the boardlock 20 is formed from continuous sheet metal stock of a sufficient thickness and hardness to serve as a holding device by virtue of the deflectable legs and the hook arm. Materials such as brass, phosphor bronze, or stainless steel may be employed. In one example, the thickness of the material is 0.017 inches. However, this thickness can be varied depending on the particular need of the boardlock. The dimension of the mounting holes are sufficiently large to allow deflection of the deflectable legs and the arm respectively to provide an elastic spring action holding the legs, and therefore the points, in engagement with the surface of the printed circuit board and the hook arm in engagement with the surface of the component.

It is felt that the boardlock of the present invention and many of its attendant advantages will be understood from the foregoing description. It is apparent that varies changes may be made in the form, construction, and arrangement of parts thereof without departing from the spirit or scope of the invention, or sacrificing all of its material advantages.

What is claimed is:

1. A holding device, comprising:

a body member having a central portion with two resilient legs extending therefrom in a first direction, the legs having engagement members for engaging a circuit board, the body member having a hook arm extending in a second direction from the central portion for engagement with a component, the hook arm having a first portion extending in the second direction and a resiliently deflectable portion extending towards the central portion, the resiliently deflectable portion being deflectable towards the first portion to allow passage through a mounting hole, and having an end for engaging the component to secure the body member thereto, the body member being planar such that the central portion, the resilient legs and the hook arm are all in the same plane, whereby the body member secures the components to the circuit board.

2. The holding device of claim 1, wherein the resilient legs have straight portions which are to be received within the mounting hole on the component.

3. The holding device of claim 2, wherein the resilient legs have stop members to engage the component and secure the holding device to the component.

4. The holding device of claim 1, wherein the resilient legs have board engaging portions, the board engaging portions having angled surfaces to provide for deflection of the legs during insertion of the body member into a mounting hole on the circuit board and angled surfaces for engaging a side of the circuit board for securing the body member to the circuit board.

5. The holding device of claim 1, wherein the first portion of the hook arm has an end opposite to the central portion, the resiliently deflectable portion extending from the end of the first portion.

6. A boardlock device comprising a substantially planar member having a central portion, two resilient legs extend from the central portion in a first direction, a hook arm extending from the central portion in a second direction, the hook arm having a first section extending from the central portion in a second direction, the hook arm having a resilient arm extending from the first section towards the central portion, the resilient arm providing a snap action to secure the boardlock device into a mounting hole on a component to be mounted to a board, whereby the boardlock device secures the component on a circuit board.

7. The holding device of claim 6, wherein the resilient legs have straight portions which are to be received within the mounting hole on the component.

8. The holding device of claim 7, wherein the resilient legs have stop members to engage the component and secure the holding device to the component.

9. The holding device of claim 6, wherein the resilient legs have board engaging portions, the board engaging portions having angled surfaces to provide for deflection of the legs during insertion of the body member into a mounting hole on the circuit board and angled surfaces for engaging a side of the circuit board for securing the body member to the circuit board.

10. The holding device of claim 6, wherein the first section of the hook arm has an end opposite to the central portion, the resilient arm extending from the end of the first portion.

11. A holding device for securing two components together, the first component having a first mounting hole and the second component having a second mounting hole, the holding device having a central portion with two resiliently deflectable legs extending therefrom, the legs having securing members for engaging and securing the second mounting hole of the second component, a hook arm extending from the central portion for engaging the first mounting hole on the first component, the hook arm having a first portion extending away from the central portion and a second portion extending towards the central portion, the second portion being a resiliently deflectable arm which is deflectable towards the first portion, the holding device being substantially planar such that the central portion, the resiliently deflectable legs and the hook arm being disposed in the same plane, whereby the holding device secures the first and the second components together.

12. The holding device of claim 11, wherein the resilient legs have straight portions which are to be received within the first mounting hole on the first component.

13. The holding device of claim 12, wherein the resilient legs have stop members to engage the first component and secure the holding device to the first component.

14. The holding device of claim 11, wherein the resilient legs have component engaging portions, the component engaging portions having angled surfaces to provide for deflection of the legs during insertion of the holding device into the second mounting hole on the second component and angled surfaces for engaging a side of the second component for securing the holding device to the second component.

15. The holding device of claim 11, wherein the first portion of the hook arm has an end opposite to the central portion, the resiliently deflectable arm extending from the end of the first portion.

* * * * *